United States Patent [19]

Jornot

[11] Patent Number: 4,996,748

[45] Date of Patent: Mar. 5, 1991

[54] DOUBLE FEED TABLE

[75] Inventor: Erich Jornot, Seuzach, Switzerland

[73] Assignee: Maschinenfabrik Rieter AG, Winterthur, Switzerland

[21] Appl. No.: 422,149

[22] Filed: Oct. 16, 1989

[30] Foreign Application Priority Data

Nov. 3, 1988 [CH] Switzerland ..... 0408788

[51] Int. Cl.[5] ..... D01H 13/04

[52] U.S. Cl. ..... 19/157; 19/159 A

[58] Field of Search ..... 19/0.21, 0.22, 0.25, 19/243, 145, 159 A, 157

[56] References Cited

U.S. PATENT DOCUMENTS

| | | | |
|---|---|---|---|
| 2,442,478 | 6/1948 | Watson | 19/0.22 |
| 3,330,007 | 7/1967 | Foster | 19/0.25 |
| 3,345,695 | 10/1967 | Rayfield et al. | 19/0.25 |
| 4,195,388 | 4/1980 | Bulla | 19/157 |
| 4,443,913 | 4/1984 | Klazar | 19/159 A |
| 4,577,372 | 3/1986 | Roder | 19/159 A |

FOREIGN PATENT DOCUMENTS

| | | | |
|---|---|---|---|
| 2230644 | 9/1975 | Fed. Rep. of Germany . | |
| 611315 | 9/1926 | France | 19/164 |
| 39-12875 | 7/1964 | Japan | 19/157 |
| 703639 | 2/1954 | United Kingdom | 19/157 |
| 1540491 | 2/1979 | United Kingdom . | |

*Primary Examiner*—Werner H. Schroeder
*Assistant Examiner*—John J. Calvert
*Attorney, Agent, or Firm*—Dority & Manning

[57] ABSTRACT

The invention relates to a spinning can creel for the feeding of textile fiber slivers to a processing machine with which several spinning cans are arranged along a spinning can creel, and a take-off mechanism is assigned to every textile fiber sliver for the transport of the textile fiber slivers. The textile fiber slivers are brought to a processing machine over a transport unit.

14 Claims, 2 Drawing Sheets

DOUBLE FEED TABLE

BACKGROUND OF THE INVENTION

The invention relates to a spinning can creel for feeding textile fiber slivers to a processing machine in which several spinning cans containing textile fiber slivers are arranged along a spinning can creel, on one or both sides to form ropes from textile fiber slivers, with a take-off mechanism assigned to each textile fiber sliver for the withdrawal of the sliver from the spinning can, whereby the textile fiber slivers (which are drawn out) are transferred by a conveyor to the transport unit of the processing machine.

In prior German Patent Specification No. 22 30 644, an arrangement is described, whereby the textile fiber slivers are taken from containers located in a spinning can creel, by a take-off mechanism to a following conveyor.

The conveyor transfers these textile fiber slivers, in a more or less parallel state, to a subsequent processing machine.

In addition, with this prior arrangement, a reserve can is assigned to the can in operation at the time. In the case of a sliver break, or if a sliver runs out, the reserve sliver is automatically fed by a take-off mechanism assigned to the reserve sliver without stopping the subsequent processing machine or the feed sliver.

The feeding of a new or a reserve sliver and the piecing of the sliver with the end of the new sliver is not always problem-free with the prior arrangement. This means the point of piecing can be formed so that it is either too thick or too thin or the connection can be inadequately formed.

In view of the very high working speeds customary of the present day, automatic feeding of the reserve sliver arrangement is no longer possible under certain circumstances. To avoid such faults, one is compelled, as hitherto, to piece the end of the sliver to the start of the new sliver manually and, in certain circumstances, with suitable auxiliary measures.

This, however, occasions a short stop of the operating machine or of the transport unit leading to the processing machine.

The procedure requires a reduction of the drive speed to zero (which takes a certain time) for the shutdown time, or an appropriate shutdown distance is required until the installation stops.

Due to the continuous demand for higher production, the result is that demands for higher processing speeds become more insistent within the framework of present technical development, whereby the shutdown distance is increased. Now, if the sliver runs out at the next waiting can of the processing machine, it can happen that the end of the sliver first comes to a stop after it has already been drawn into the subsequent processing machine.

If the end of the sliver is still in the front part of the processing machine, e.g., a drawframe, it is sometimes possible, with a certain amount of trouble, to piece the end of the old sliver to the start of the new sliver.

However, if the end of the old sliver is already in the drafting area, then piecing is no longer possible, which means that a sliver fault results.

In order to avoid such occurrences, it is conceivable to arrange a clearance from the front can or the entire spinning can creel as far as the point of introduction of the processing machine, whereby the end of the sliver still stops before the entry into the processing machine and, because of this clearance, it is also still possible to piece a reserve sliver automatically.

This, in turn, requires an increased space for the spinning can creel which is moved to the rear together with the necessary guiding elements.

SUMMARY OF THE INVENTION

The object of the invention is to produce an arrangement which makes it possible to connect the spinning can creel compactly with the subsequent processing machine, whereby the attachment of a new sliver can be effected automatically or manually without problems, even at high operating speeds.

This object has been accomplished by arranging one or more conveyors to the transport unit which ensure the feeding of all the slivers, with a predetermined clearance, to the point of introduction to the processing machine, whereby the minimum dimension of the spacing between the point of introduction and the take-off mechanism of the processing machine exceeds the distance to the next waiting spinning can.

It is a further object that the conveyors of all the textile fiber slivers lead to a common delivery point of the transport unit, which is located within the spinning can creel. This makes it possible to collect the textile fiber slivers at the common delivery point into a lap suitable for the processing machine.

It is a further object that the feed to the transport unit is arranged in the region of the spinning can which is furthest from the processing machine, which results in good accessibility to this feed point.

The placing of the conveyor above the transport unit is advantageous with the feed to the transport unit in the region of the delivery point because the textile fiber slivers are already guided on the transport unit by their own weight.

The placing of the conveyor underneath the transport unit offers the advantage that the distance from the spinning can delivery to the take-off mechanism can be maintained relatively small and, therewith, the risk of tearing the sliver in this region is reduced.

The object of moving all the textile fiber slivers on a conveyor which moves in the opposite direction to the transport unit moves is accomplished by the simple guiding of the single textile fiber slivers to one lap in the region of the delivery point.

It is a further object that one or more conveyors be allocated to the spinning cans which are located in the front region of the spinning can creel. The front region refers to the region of the spinning can creel which is located in the area of the point of entry of the subsequent processing machine.

The allocation of single conveyors to the take-off direction provides a simple piecing of single textile fiber slivers, especially when each conveyor is separately driven so that it can be individually controlled.

A manual piecing of reserve slivers is still possible on the conveyor when the spacing to the delivery point on the transport unit corresponds, at least, to the shutdown distance.

An automatic piecing up is possible when the minimum spacing from the delivery point is selected so that automatic piecing of a reserve sliver is assured by a sliver held in readiness in the reserve position.

The placing of the guide element in the region of the delivery point facilitates the junction of the transported slivers to a suitable lap for the subsequent processing machine. THe junction to a fiber lap in the region of the delivery point facilitates a simple and problem-free piecing up of one or more reserve slivers in this region.

It is a further object that a reserve spinning can be assigned to every spinning can in operation in order to ensure the rapid piecing up of a reserve sliver.

BRIEF DESCRIPTION OF THE DRAWINGS

Further advantages of the invention are more closely described by way of example with the aid of the following drawings, in which.

DETAILED DESCRIPTION OF THE INVENTION

Figure 1:
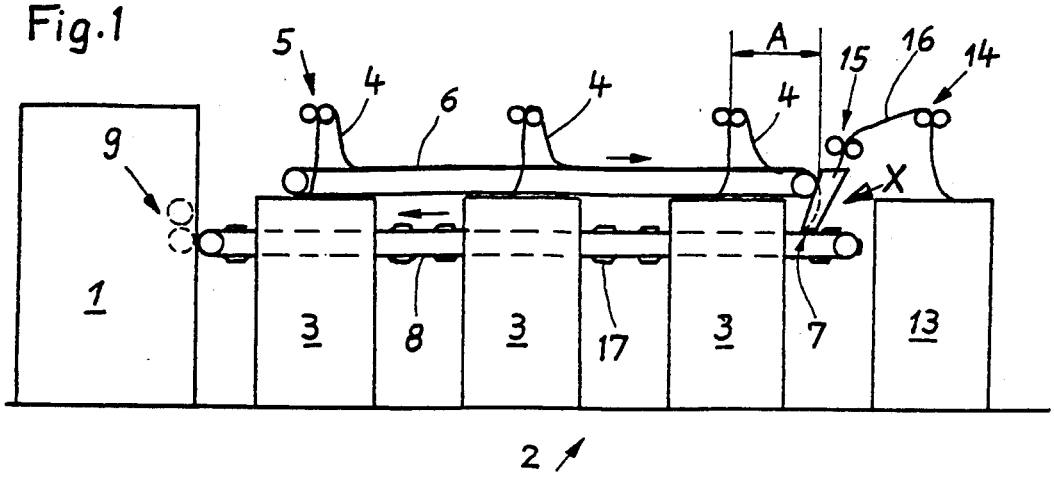
FIG. 1 shows a schematic side view with a device according to the invention for feeding the slivers to the transport unit.
Figure 2:
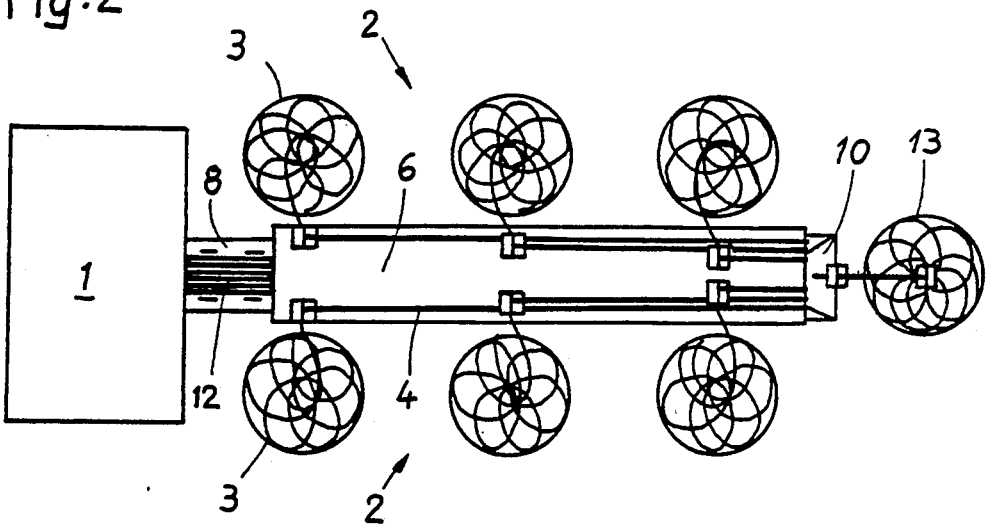
FIG. 2 shows a schematic top view of the device of FIG. 1.

FIGS. 1 and 2 show a fiber processing machine, e.g., a drawframe 1, in which spinning cans 3 are arranged in two rows in a spinning can creel 2.

The textile fiber slivers 4 contained in the spinning cans are delivered through a take-off mechanism 5 to a conveyor 6. The conveyor 6 transports the textile fiber slivers 4 in a direction away from the drawframe 1.

At the end of the conveyor belt 6, the slivers 4 are delivered downwards, at the delivery point 7, in the direction towards the drawframe by transporting conveyor 8.

The slivers which are fed to the drawframe 1 in this way are taken from the feed rolls 9 of the drawframe 1 and further transported for processing in the drawframe 1.

Figure 3:
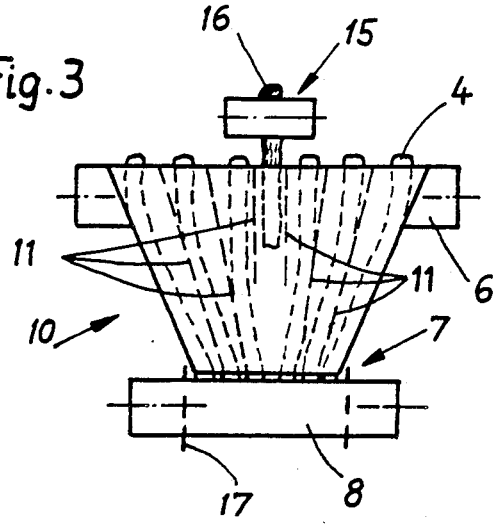
FIG. 3 shows an enlarged rear view of the detail "X" in FIG. 1.

In the region of the delivery point 7, a guide plate 10 is arranged which is provided with guide rails 11 (FIG. 3). Guide plate 10 tapers downwards in the direction towards the delivery point 7, whereby the slivers 4 are joined into a fiber lap 12.

A reserve can 13 is arranged behind the spinning can creel 2, from which a reserve sliver 16 can be guided into the upper region of the guide plate 10 by a take-off mechanism 14 and guide rollers 15. The take-off mechanism 5 of the rear can is separated by a distance A from the delivery point. Distance A corresponds, at least, to the shutdown distance required to stop the transport unit at the end of the sliver or with a sliver break on the drawframe 1. In this way, manual piecing up of a new sliver 4 or of a reserve sliver 16 on the conveyor 6 or in the region of the guide plate 10 is made possible without problems. Equally, with an appropriate separation A of the reserve sliver 16, it is possible, in the time, to piece up with the reserve sliver automatically in the region of the guide plate without stopping the transport unit.

The transport conveyor 8 is provided with guide elements 17 for improved guidance of the fiber lap 12.

Figure 4:
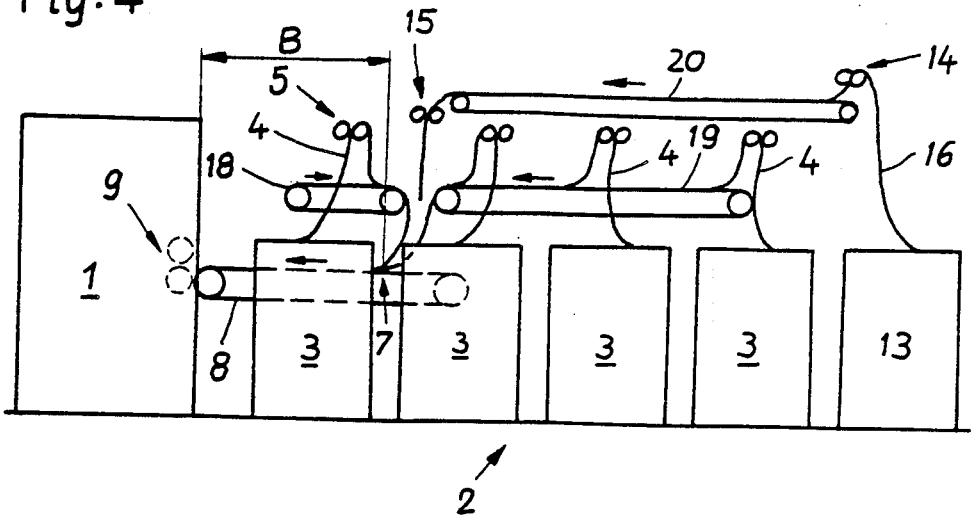
FIG. 4 shows a schematic side view of a further embodiment of the invention.

FIG. 4 shows a further embodiment of the invention in which the delivery point 7 of the transport conveyor 8 is arranged in the front part of the spinning can creel 2, whereby the spacing B is greater than the shutdown distance required when stopping the drawframe, or is so large that automatic piecing up of a reserve sliver is possible without stopping the machine. The slivers 4 of the front cans 3 are transported over a conveyor belt 18 and the slivers 4 of the further cans 3 are transported over a conveyor 19 to the delivery point 7. The transport units are driven, as shown in FIG. 4, in opposite directions whereby the front conveyor 18 transports the fiber sliver 4 from the drawframe 1. The transport conveyor 8, which is maintained substantially shorter with this form of construction, transports the fiber sliver which is fed to the feeding rollers 9 of the drawframe 1. A reserve sliver 16 is arranged for piecing up in the region of the feeding ends of the conveyors 18 and 19. The reserve sliver 16 is brought into this position from the reserve can 13 standing at the end of the spinning can creel by a take-off mechanism 14, a transport element 20 and the guide rollers 15. It is conceivable to arrange the transport element 20 as well as the guide rollers 15 to be laterally movable, when seen in a top view, with the object of the replacement of a missing sliver 4. This lateral movement is also possible with the examples shown in FIGS. 1 to 3.

Figure 5:
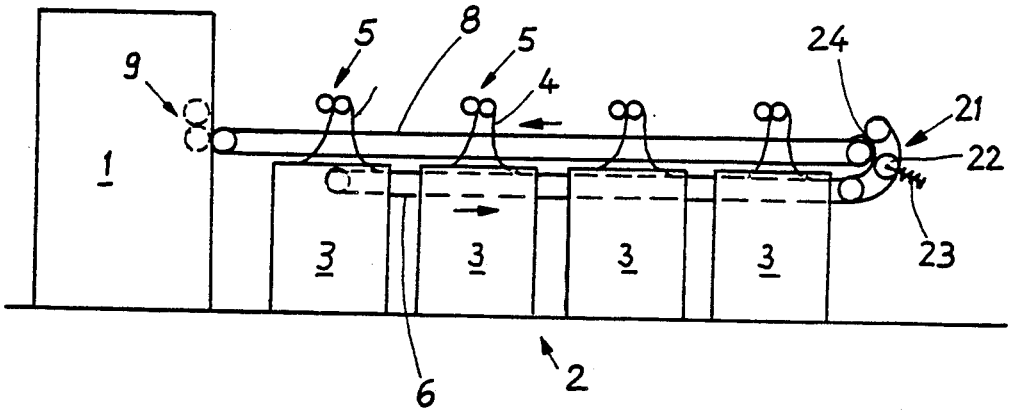
FIG. 5 shows a side view of a further embodiment of the conveyor according to the invention.

FIG. 5 shows a further embodiment of the invention whereby the conveyor 6 is arranged underneath the transport conveyor 8. The sliver 4 is again laid on the conveyor 6 over the take-off mechanism 5 and passes to a deviating position 21. The deviating position 21 is so arranged that it is semi-circular and lies on the rear end of the transport conveyor 8, whereby a clamping or nipping position 24 is provided in this region for the transport of the slivers. This clamping position 24 is achieved by the fact that, in the region of the deviating position 21, a guide roller 22 of the conveyor 6 operates over a spring 23 urging it in the direction of the transport conveyor 8.

The clamping effect which results carries the textile fiber slivers 4 into the upper region of the diverting position 21 and, as a result of its own weight, to the transport conveyor 8 where it is transferred to the feed rollers 9. The possibility of piecing a reserve sliver can be realized over the entire length of the transport conveyor 8 up to a point just short of the feed rollers.

Figure 6:
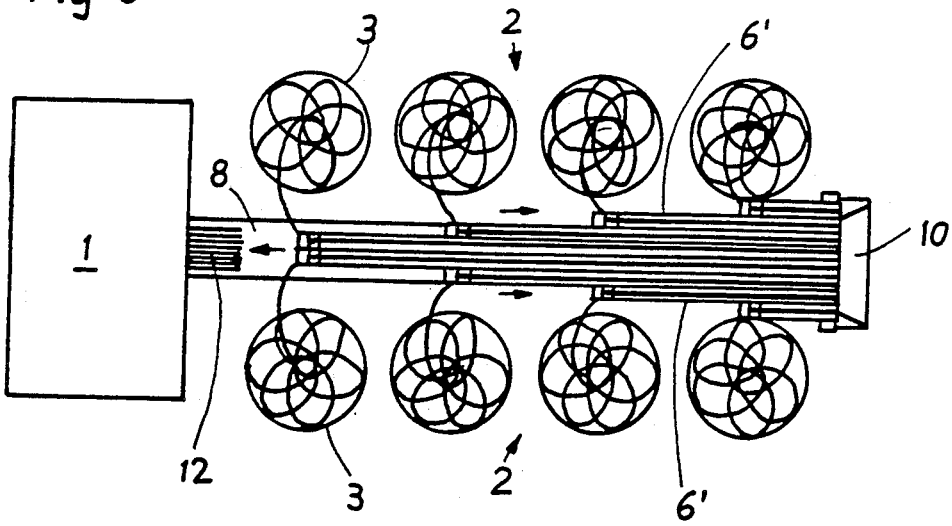
FIG. 6 shows a schematic plan view of a further embodiment of the invention.

The example shown in FIG. 6 corresponds essentially to the construction shown in FIG. 1, whereby only the conveyor 6 is divided into separate conveyors for each of the slivers. The advantage of this arrangement is that the piecing up of a textile fiber sliver is facilitated, particularly when each of the conveyors has a separate drive.

I claim:

1. A spinning can creel for feeding a plurality of textile fiber slivers to a fiber processing machine, comprising:

(a) a plurality of spinning cans arranged in at least one row;

(b) a sliver take-off mechanism for each of said cans for removing sliver therefrom and for advancing said sliver;

(c) conveyor belt means for receiving each of said advanced slivers from said sliver take-off mechanisms and advancing said slivers;

(d) means for directing said slivers from said conveyor means to a delivery point;

(e) a transport unit for receiving said slivers at said delivery point and for transporting said slivers towards said fiber processing machine; and (f) feed rolls carried by said fiber processing machine for feeding said slivers to said sliver processing machine, said feed rolls being spaced a distance from said delivery point which is greater than the sliver feeding distance required for stopping said fiber processing machine.

2. A spinning can creel as set forth in claim 1, wherein said conveyor belt means comprises a plurality of conveyor belts, each of which extends to said delivery point.

3. A spinning can creel as set forth in claim 1, wherein guide elements are disposed in the region of said delivery point for guiding said textile fiber slivers onto said transport unit.

4. A spinning can creel as set forth in claim 1, wherein a reserve spinning can is provided for each spinning can from which sliver is taken off by said take-off mechanism.

5. A spinning can creel as set forth in claim 1, which includes a reserve sliver feeding device for delivering a reserve sliver to said delivery point.

6. A spinning can creel as set forth in claim 1, wherein said conveyor belt means is disposed below said transport unit.

7. A spinning can creel as set forth in claim 6, wherein said conveyor belt means includes an arcuate portion for guiding said slivers onto said transport unit.

8. A spinning can creel as set forth in claim 3, wherein said guide elements guide said slivers together to form a fiber lap.

9. A spinning can creel as set froth in claim 8, wherein a delivery device is included in the guide elements for guiding at least one reserve sliver.

10. A spinning can creel for feeding a plurality of textile fiber slivers to a fiber processing machine, comprising:

(a) a plurality of spinning cans arranged in at least one row;

(b) a sliver take-off mechanism for each of said cans for removing sliver therefrom and for advancing said sliver;

(c) conveyor means for receiving each of said advanced slivers from said sliver take-off mechanisms and advancing said slivers;

(d) means for directing said slivers from said conveyor means to a delivery point disposed in the region of the spinning can furthest removed from said processing machine;

(e) a transport unit for receiving said slivers at said delivery point and for transporting said slivers towards said fiber processing machine; and (f) feed rolls carried by said fiber processing machine for feeding said slivers to said sliver processing machine, said feed rolls being spaced a distance from said delivery point which is greater than the sliver feeding distance required for stopping said fiber processing machine.

11. A spinning can creel for feeding a plurality of textile fiber slivers to a fiber processing machine, comprising:

(a) a plurality of spinning cans arranged in at least one row;

(b) a sliver take-off mechanism for each of said cans for removing sliver therefrom and for advancing said sliver;

(c) conveyor means for receiving each of said advanced slivers from said sliver take-off mechanisms and advancing said slivers;

(d) means for directing said slivers from said conveyor means to a delivery point;

(e) a transport unit disposed below said conveyor means for receiving said slivers at said delivery point and for transporting said slivers towards said fiber processing machine; and (f) feed rolls carried by said fiber processing machine for feeding said slivers to said sliver processing machine, said feed rolls being spaced a distance from said delivery point which is greater than the sliver feeding distance required for stopping said fiber processing machine.

12. A spinning can creel for feeding a plurality of textile fiber slivers to a fiber processing machine, comprising:

(a) a plurality of spinning cans arranged in at least one row;

(b) a sliver take-off mechanism for each of said cans for removing sliver therefrom and for advancing said sliver;

(c) a plurality of driven conveyors for receiving each of said advanced slivers from said sliver take-off mechanisms and advancing said slivers in a first direction;

(d) means for directing said slivers from said conveyor means to a delivery point;

(e) a transport unit for receiving said slivers at said delivery point and for transporting said slivers towards said fiber processing machine in a direction opposite to said first direction; and (f) feed rolls carried by said fiber processing machine for feeding said slivers to said sliver processing machine, said feed rolls being spaced a distance from said delivery point which is greater than the sliver feeding distance required for stopping said fiber processing machine.

13. A spinning can creel as set forth in claim 12, wherein each of said sliver take-off mechanisms advances its sliver to a separate conveyor which advances said sliver to said delivery point.

14. A spinning can creel as set forth in claim 12, wherein the distance to said delivery point is not less than the distance said slivers advance during the shutdown of said fiber processing machine.

* * * * *